US006684859B2

(12) United States Patent
Bredesen et al.

(10) Patent No.: US 6,684,859 B2
(45) Date of Patent: Feb. 3, 2004

(54) FUEL INJECTOR TAPPET RETENTION MECHANISM

(75) Inventors: Matthew A. Bredesen, Chicago, IL (US); Daniel R. Ibrahim, Bloomington, IL (US); Ralph A. Smith, III, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 104 days.

(21) Appl. No.: 10/121,741

(22) Filed: Apr. 12, 2002

(65) Prior Publication Data

US 2003/0192510 A1 Oct. 16, 2003

(51) Int. Cl.[7] ..... F02M 55/02
(52) U.S. Cl. ..... 123/470; 123/90.48
(58) Field of Search ..... 123/470, 468, 123/467, 509, 90.48; 239/88, 89, 90, 91, 92

(56) References Cited

U.S. PATENT DOCUMENTS 5,074,269 A 12/1991 Herbon et al.
5,520,155 A 5/1996 Hefler
5,873,527 A * 2/1999 Pattanaik et al. ..... 239/91
6,209,798 B1 4/2001 Martin et al.
6,607,149 B2 * 8/2003 Smith et al. ..... 239/585.1

FOREIGN PATENT DOCUMENTS

GB 2330626 * 4/1999

* cited by examiner

*Primary Examiner*—Mahmoud Gimie
(74) *Attorney, Agent, or Firm*—Jason J Stanley

(57) ABSTRACT

During assembly, shipping and handling before a mechanically-actuated fuel injector is installed into an internal combustion engine, the fuel injector tappet often accidentally disconnects from the fuel injector body. This separation of the tappet from the fuel injector body is caused by a force placed upon the tappet by a biasing means, such as a spring, that pushes the tappet away from the injector body. The fuel injector of the present application solves this problem through the interaction of a retention clip, a retention opening in the fuel injector body, and a retention slot in the fuel injector tappet. The retention clip has a body and a protrusion. The retention clip body is contained within the fuel injector body, and the protrusion extends through the retention opening and into the retention slot. After it is assembled, the fuel injector of the present application remains connected during shipping and handling and permits easy installation into an internal combustion engine.

29 Claims, 5 Drawing Sheets

FUEL INJECTOR TAPPET RETENTION MECHANISM

TECHNICAL FIELD

The present invention relates generally to tappet assemblies for fuel injectors, and more particularly to a mechanism that maintains a tappet connected to the body of a fuel injector during shipping, handling and installation.

BACKGROUND

One class of fuel injectors used in internal combustion engines, such as diesel engines, are mechanically actuated via a rocker arm assembly that moves with each rotation of an engine's cam shaft. The rocker arm moves a tappet downward, and a plunger underneath the tappet pressurizes fuel during the downward stroke. A spring retracts the plunger and tappet between injection events. The spring, which is always compressed, also maintains the tappet in contact with the rocker arm throughout the operation of the system. In most of these types of injectors, the spring pushes the tappet away from the injector body, but the rocker arm limits how far the tappet can be moved away from the injector body, and thus prevents the tappet from disconnecting from the injector body after installation.

During assembly, shipping and handling before the injector is installed in an engine, there is often the possibility that the tappet will accidentally disconnect from the injector body. This occurs because the tappet return spring pushes the tappet away from the injector body, and there is often no means provided for holding the tappet connected to the injector body prior to installation. In some instances, it is possible to use an external clamping mechanism to hold the tappet to the injector body prior to, and during, installation in an engine. However, in many cases space constraints during installation are so severe that no room on the outside of the assembled injector is available for retaining the tappet in the injector body. In these cases, one must either include an internal retention means or accept the risk that some tappets will become disconnected from their respective injector bodies during pre-installation shipping and handling. Oftentimes internal retention means are limited or unavailable due to internal structural and space constraints. In addition, any retention means should be either removable upon installation or arranged such that the same will not interfere with normal operation of the injector after being installed in an engine.

U.S. Pat. No. 6,209,798 issued to David E. Martin et al. on Apr. 3, 2001 shows a fuel injector having a retention member positioned in a retention opening in at least one of the tappet assembly and the injector body. The retention member limits the movement of the tappet assembly with respect to the fuel injector body. The tappet assembly disclosed in Martin has a plunger and a tappet consisting of a holder member and a plug member. The installation of the tappet assembly includes installing the retention member after the holder member is installed, but before the installation of the plug member. Improvements to the invention disclosed in Martin can be made.

The present invention is directed to overcoming one or more of the problems as set forth above.

SUMMARY OF THE INVENTION

In one aspect of apparatus of the present application, a fuel injector has a body, a tappet, and a retention clip. The body has a retention opening therethrough. The tappet is slidably engaged with the fuel injector body and defines a retention slot. The retention clip is located within the fuel injector body and has a projection that extends through the retention opening and into the retention slot.

In one aspect of the method of the present application, a method of making a fuel injector includes providing a fuel injector body, a tappet and a retention clip as described above, inserting the retention clip into the fuel injector body such that the retention clip protrusion extends through the retention opening, and engaging the tappet with the fuel injector body such that the retention slot is aligned with the retention opening and the retention clip protrusion extends into the retention slot.

DETAILED DESCRIPTION

Referring to the Figs., an internal combustion engine 10 is shown. The engine 10 includes a cylinder block 12, a cylinder head 14 attached to the block 12, and a valve cover 16 attached to the head 14. These components are of a generally conventional design.

Figure 1:
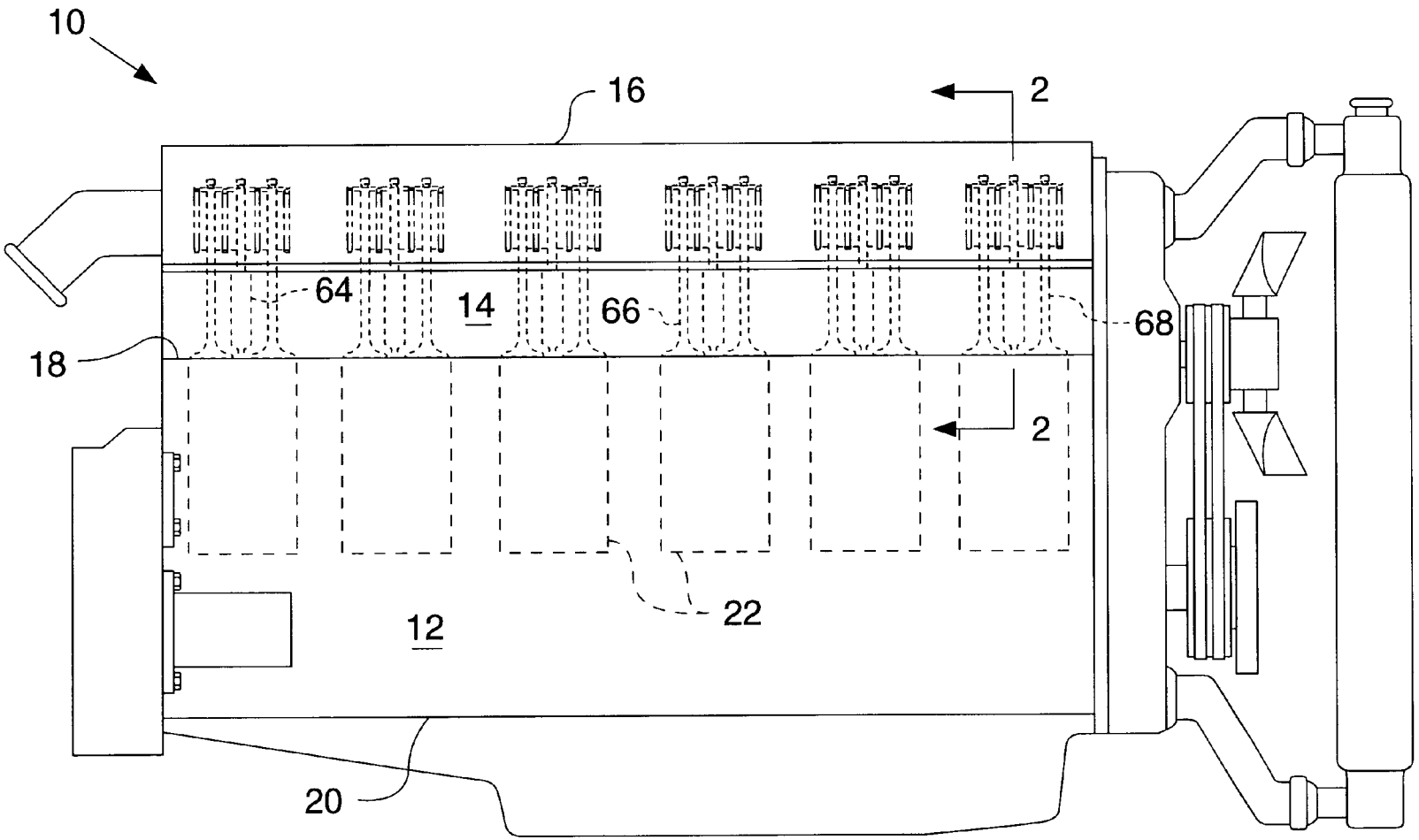
FIG. 1 is a side view of an engine.
Figure 2:
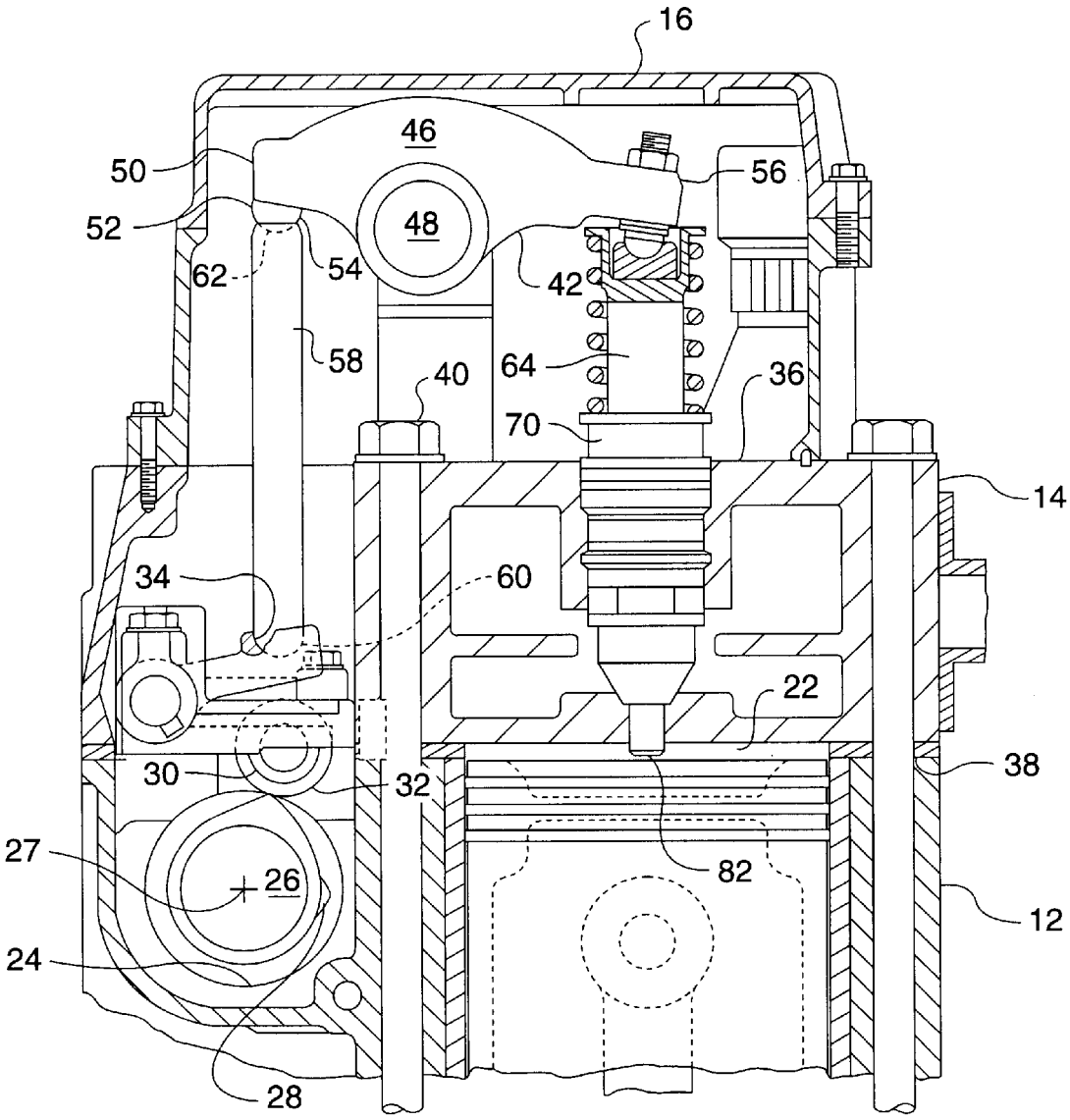
FIG. 2 is a cross sectional view taken along line 2—2 of FIG. 1 of the engine.

Referring now to FIG. 1, the block 12 includes a top mounting surface 18, a bottom mounting surface 20, a plurality of cylinder bores 22 located between the top mounting surface 18 and the bottom mounting surface 20, and, as shown in FIG. 2, a longitudinally disposed through bore 24 spaced from the centers of the plurality of cylinder bores 22 and intermediate the top and bottom mounting surfaces 18, 20. In the embodiment shown in FIG. 1, six cylinder bores 22 are equally spaced, in-line, and perpendicularly positioned with respect to the top mounting surface 18. However, the cylinder block 12 may be of any other conventional design, such as "V" or radial, and may have any number of bores 22. Referring to FIG. 2, the block 12 contains a cam shaft 26 rotatably positioned within the through bore 24 that is driven by a conventional mechanism, not shown. The camshaft 26 has a centerline axis 27 and a plurality of profile cam portions 28 thereon. A plurality of roller cam followers 30 of conventional design are in contact with the camshaft 26. Each of the roller cam followers 30 has a roller 32 and a cupped portion 34.

Referring to FIG. 2, the cylinder head 14 includes a valve cover mounting surface 36 and a block mounting surface 38. The cylinder head 14 is attached to the block 12 by a plurality of bolts 40. In this application, a plurality of rocker arm assemblies 42 are attached to the head 14 in a conventional arrangement. As an alternative, a single rocker arm assembly 42 could be used. In the specific example shown, an individual rocker arm assembly 42 is provided for each of the cylinder bores 22. Each of the rocker arm assemblies 42 includes at least one rocker arm 46 pivotally mounted on a shaft 48 and attached to the head 14 in a conventional manner. In the specific example illustrated, three rocker arm assemblies 42 are provided for each cylinder bore 22 of a six cylinder engine. Each of the rocker arms 46 has a first end 50 including a pin 52 having a spherical head 54 thereon. Each of the rocker arms 46 has an actuation end 56. A pushrod 58 has a spherical end 60 and a cupped end 62 having a contacting surface normally in contact with the spherical head 54 of the rocker arm 46. The spherical end 60 of the pushrod 58 is in contact with the cupped portion 34 of one of the plurality of roller cam followers 30. One of the rocker arms 46 engages a fuel injector 64 in a conventional manner. A similar rocker arm 46 is used with each of a plurality of intake and exhaust valves, 66 and 68, respectfully, shown in FIG. 1.

Figure 3:
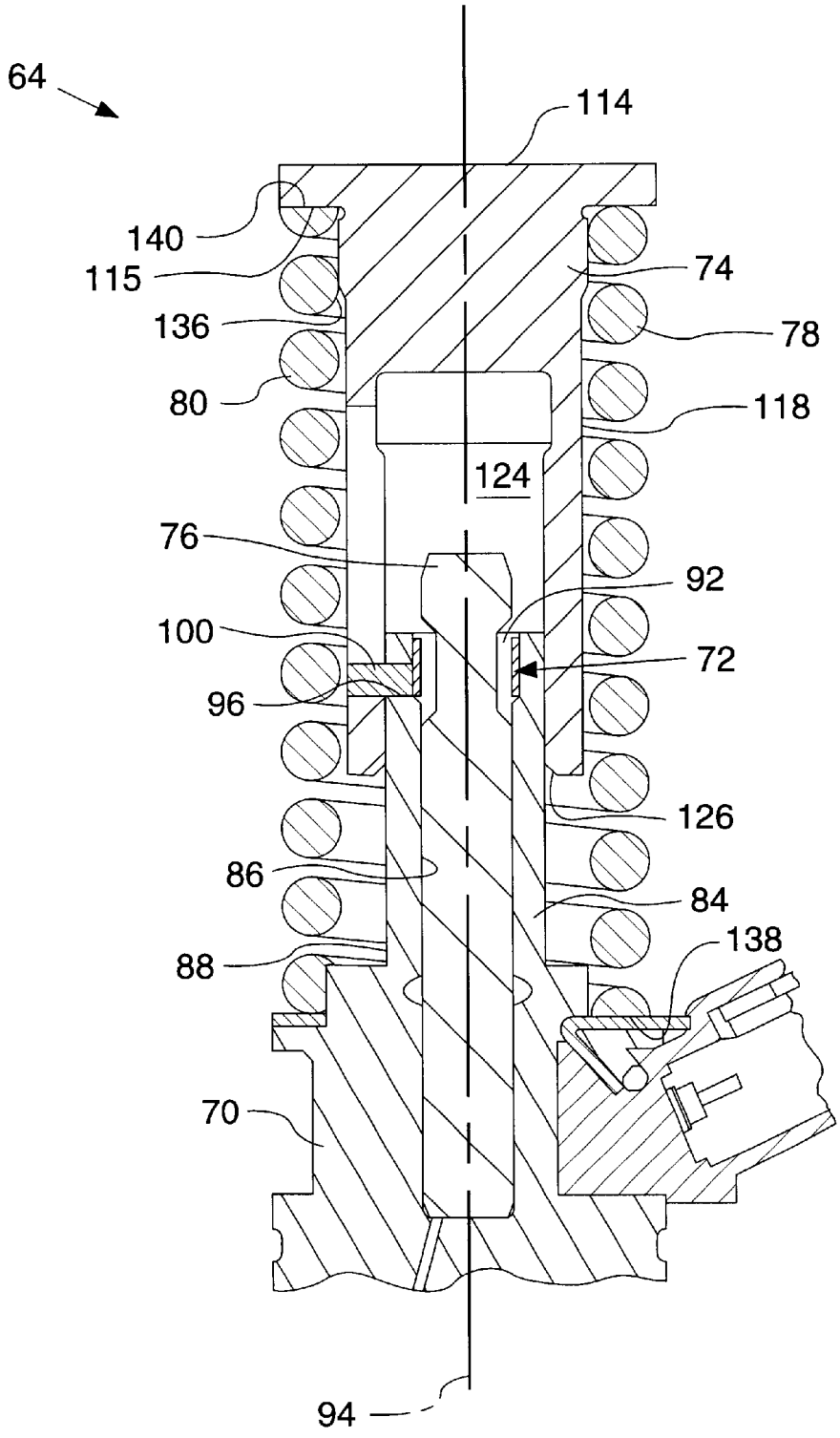
FIG. 3 is an enlarged cross-sectional view of a fuel injector within the engine.
Figure 4:
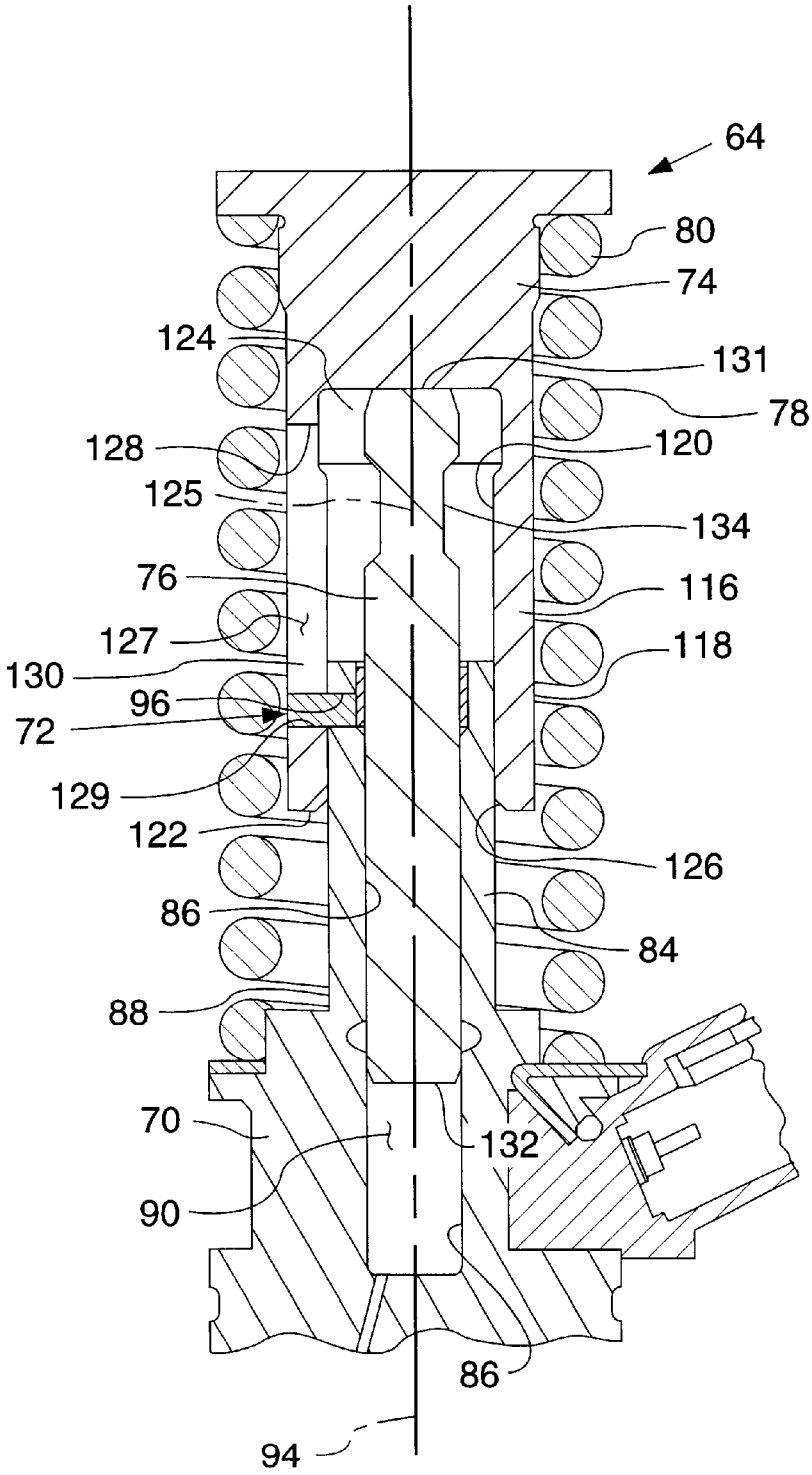
FIG. 4 is a cross-sectional view of the fuel injector of FIG. 3.

Referring to FIG. 3, the fuel injector 64 includes a body 70, a retention clip 72, a tappet 74, a plunger 76, and a biasing means 78, such as a spring 80. Referring to FIG. 2, at one end the injector body 70 defines a nozzle 82 that is adjacent to the cylinder bore 22. As shown in FIG. 4, at the end opposite the nozzle 82 the injector body 70 defines a barrel 84 having an inner surface 86 and an outer surface 88. The inner surface 86 of the barrel 84 defines a bore 90 therein. Referring to FIG. 3, a portion of the barrel 84 defines an annular retention clip gallery 92 having a diameter that is larger than the diameter of the rest of the inner surface 86 of the barrel 84. The retention clip gallery 92, barrel 84 and bore 90 are centered about a centerline axis 94. In the retention clip gallery 92, the barrel 84 has a retention opening 96 that extends through both the barrel inner surface 86 and the barrel outer surface 88.

Figure 5:
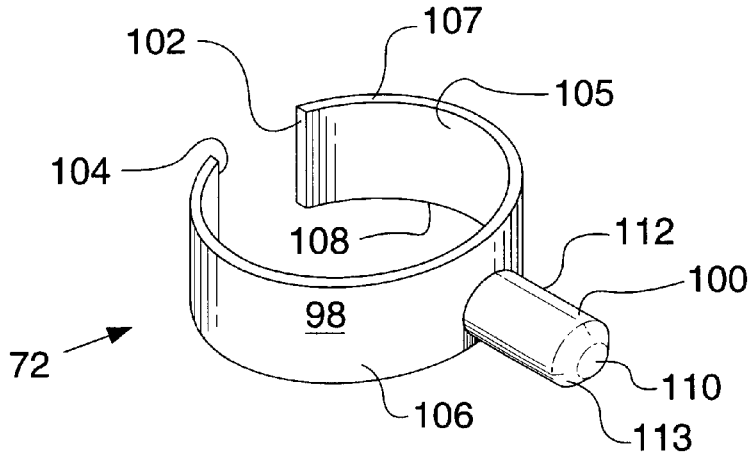
FIG. 5 is an enlarged perspective view of a retention clip within the fuel injector.

Referring to FIG. 5, the retention clip 72 has a body 98 and a protrusion 100 attached to the body 98. The retention clip body 98, which has an annular configuration, has a first end 102, a second end 104 spaced from the first end 102, an inner surface 105, an outer surface 106, a top surface 107, and a bottom surface 108. The diameter of the outer surface 106 of the retention clip body 98 is less than the diameter of the retention clip gallery 92 of the injector body 70, such that the retention clip body 98 will fit within the retention clip gallery 92. The protrusion 100 of the retention clip 72 extends from the outer surface 106 of the retention clip body 98. The protrusion 100 has a first end 110 and at least one outer surface 112. Although, in the embodiment shown in FIG. 5 the protrusion 100 is substantially cylindrical, the cross-section of the protrusion 100 may be of any shape, such as a square or rectangle. The at least one outer surface 112 and the first end 110 may intersect via a chamfered edge 113. As shown in FIG. 3, the protrusion 100 is dimensioned such that the protrusion 100 can be inserted into and project from the retention opening 96 in the fuel injector body 70.

Figure 6:
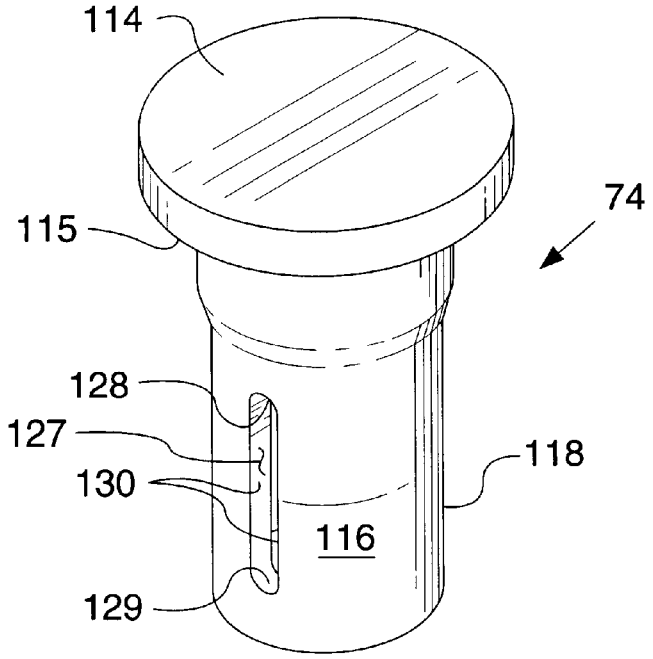
FIG. 6 is an enlarged perspective view of a tappet within the fuel injector.

Referring to FIG. 6, the tappet 74 has a top 114 and a surface 115 spaced from the top 114 of the tappet 74. A cylindrical body 116 extends from the top 114 of the tappet 74. Referring to FIG. 4, the cylindrical body 116 has an outer surface 118, an inner surface 120, and a bottom surface 122. The inner surface 120 defines a cylindrical tappet bore 124. The diameter of the cylindrical tappet bore 124 is greater than the diameter of the outer surface 88 of the injector body barrel 84 such that the inner surface 120 of the tappet cylindrical body 116 slidably engages with the injector body barrel outer surface 88. The cylindrical body 116 and the cylindrical tappet bore 124 are centered about a tappet longitudinal axis 125. The inner surface 120 and the cylindrical body bottom surface 122 may intersect via a chamfered edge 126. The cylindrical body 116 has a retention slot 127 that extends through the inner surface 120 and the outer surface 118 of the cylindrical body 116. The retention slot 127 is substantially parallel with the tappet longitudinal axis 125 and has a top 128, a bottom 129, and a pair of sides 130. The width of the retention slot 127, defined as the distance between the sides 130 of the retention slot 127, is greater than the width of the protrusion 100 such that the protrusion 100 will fit therein and be slidably engaged with the retention slot 127.

Referring to FIG. 4, the fuel injector plunger 76 is substantially cylindrical and has a first end 131 and a second end 132. The diameter of the plunger 76 is less than the diameter of the inner surface 86 of the injector body barrel 84 such that the plunger 76 may be slidably disposed within the injector body bore 90. The plunger 76 also has an annular indentation 134 with a diameter that is less than the diameter of the rest of the plunger 76. The length of the annular indentation 134 is at least equal to the distance between the top surface 107 and the bottom surface 108 of the retention clip body 98. The plunger 76 may be free-floating or it may be attached to the tappet 74.

In the embodiment shown in FIG. 3, the biasing means 78, or in this application the spring 80 of a compression-type configuration, has an inner diameter 136 being greater than or equal to the diameter of the outer surface 118 of the tappet 74. The spring 80 has a bottom end 138 that is in contact with the injector body 70 and a top end 140 that is in contact with the tappet surface 115 that is spaced from the top 114 of the tappet 74. Other biasing means that may be used with the fuel injector 64 of the present application include a plurality of Belleville washers or one or more elastomeric members.

INDUSTRIAL APPLICABILITY

The fuel injector 64 is assembled by placing the retention clip 72 into the retention clip gallery 92 of the injector body 70 and inserting the protrusion 100 of the retention clip 72 into the retention opening 96 in the injector body 70 such that the first end 110 of the protrusion 100 extends beyond the outer surface 88 of the injector body barrel 84. The first end 102 and second end 104 of the body 98 of the retention clip 72 may need to be brought closer together or overlapped to enable the retention clip 72 to be inserted into the retention clip gallery 92. After the placement of the retention clip 72 into the retention clip gallery 92, the first end 102 of the body 98 of the retention clip 72 is moved away from the second end 104 of the body 98 so that the outer surface 106 of the body 98 contacts the inner surface 86 of the barrel 84 in the retention clip gallery 92.

The second end 132 of the plunger 76 is inserted into the bore 90 of the fuel injector body 70. The second end 132 of the plunger 76 passes through the inner surface 105 of the body 98 of the retention clip 72, and the plunger 76 is retained such that the annular indentation 134 of the plunger 76 is surrounded by the body 98 of the retention clip 72. The bottom end 138 of the spring 80 is brought into contact with the injector body 70 such that the inner surface 136 of the spring 80 surrounds the outer surface 88 of the barrel 84 of the fuel injector body 70.

The tappet 74 is installed onto the fuel injector 64 by aligning the tappet retention slot 127 with the protrusion 100 of the retention clip 72 and moving the bottom surface 122 of the tappet cylindrical body 116 towards the injector body 70. The cylindrical body 116 of the tappet 74 is positioned such that the inner surface 120 of the cylindrical body 116 surrounds the outer surface 88 of the barrel 84 of the fuel injector body 70 and such that the outer surface 118 of the cylindrical body 116 of the tappet 74 is within the inner diameter 136 of the spring 80. As the cylindrical body 116 is positioned on the injector body 70, the bottom surface 122 of the cylindrical body 116 is brought into contact with the portion of the protrusion 100 of the retention clip 72 that extends beyond the outer surface 88 of the barrel 84. If the cylindrical body 116 has the chamfered edge 126, the chamfered edge 126 engages the protrusion 100 and applies a force on the protrusion 100. The protrusion 100 may be engaged at its first end 110 or at chamfered edge 113, if present. If the cylindrical body 116 does not have the chamfered edge 126, the inner surface 120 of the cylindrical body 116 engages the chamfered edge 113 of the protrusion 100 and applies a force on the protrusion 100.

A component of the force between the cylindrical body 116 of the tappet 74 and the protrusion 100 of the retention clip 72 acts substantially perpendicular to the centerline axis 94 of the fuel injector body 70, and this component of the force on the protrusion 100 forces the protrusion first end 110 towards the centerline axis 94. The movement of the protrusion 100, and the contact between the outer surface 106 of the retention clip body 98 and the inner surface 86 of the barrel 84 of the fuel injector body 70 forces the first end 102 and second end 104 of the retention clip body 98 closer together, thereby reducing the diameter of the inner surface 105 of the retention clip body 98. After such reduction, the diameter of the inner surface 105 of the retention clip body 98 is greater than or equal to the diameter of the annular indention 134 of the plunger 76 but less than the diameter of the rest of the plunger 76. Therefore, if the retention clip 72 is not aligned with the annular indentation 134 in the plunger 76, the plunger 76 will not permit the diameter of the inner surface 105 of the retention clip body 98 to decrease enough to permit the first end 110 of the protrusion 100 of the retention clip 72 to withdraw within the outer surface 88 of the barrel 84 of the fuel injector body 70.

The movement of the first end 110 of the protrusion 100 towards the centerline axis 94 of the fuel injector body 70 permits the cylindrical body 116 of the tappet 74 to slide over the retention opening 96 of the fuel injector body 70. When the movement of the cylindrical body 116 of the tappet 74 results in the retention slot 127 of the tappet 74 being located over the retention opening 96 in the fuel injector body 70, the force on the protrusion 100 of the retention clip 72 is removed. With the force removed, the elasticity of the retention clip body 98 forces the first end 102 and the second end 104 of the retention clip body 98 away from each other, thereby increasing the diameter of the inner surface 105 of the retention clip body 98 and pushing the first end 110 of the protrusion 100 through the retention opening 96 of the fuel injector body 70 and into the retention slot 127 of the tappet 74.

Prior to installation, the tappet 74 remains attached to the fuel injector 64 due to the interaction between the protrusion 100 of the retention clip 72 and the retention slot 127 in the cylindrical body 116 of the tappet 74. The spring 80 applies a force to the tappet surface 115 that acts to push the top 114 of the tappet 74 away from the fuel injector body 70. This force causes the bottom 129 of the retention slot 127 to come into contact with, and place an upward force upon, the portion of the protrusion 100 that extends from the retention opening 96 into the retention slot 127. The walls of the retention opening 96 in the fuel injector body 70 restrict movement of the protrusion 100 in a direction substantially parallel to the centerline axis 94 of the fuel injector body 70. Thus, the protrusion 100 of the retention clip 72 stops the movement of the tappet 74 away from the injector body 70 by its interaction with the bottom 129 of the retention slot 127 of the tappet 74. If the fuel injector 64 did not have a retention clip 72, the force placed upon the tappet 74 by the spring 80 could cause the tappet 74 to separate from the fuel injector 64 during shipping or at any other time before installation.

The fuel injector 64 of the present application is installed in any conventional manner, with the result that the actuation end 56 of the rocker arm 46 is in contact with the top 114 of the tappet 74. Because the retention clip body 98 is contained within the injector 64 and the protrusion 100 of the retention clip 72 does not need to project beyond the outer surface 118 of the cylindrical body 116 of the tappet 74, the fuel injector 64 may be used in any application in which typical mechanically-actuated fuel injectors are used. In addition, installation of the fuel injector 64 of the present application is quicker and easier than typical mechanically-actuated fuel injectors because no time need be spent searching for tappets 74 that have separated from the fuel injector bodies 70 and reconnecting the tappets 74 to the fuel injectors 64. In addition, the height of the assembled fuel injector 64 is near the final installed height of the fuel injector 64, which quickens the installation process.

The operation of the fuel injector 64 of the present application can be described with reference to FIGS. 2, 3 and 4. With each cycle of the engine 10, the camshaft 26 rotates, bringing one of the profile cam portions 28 into contact with one of the plurality of roller cam followers 30 and causing the roller 32 of the roller cam follower 30 to move away from the centerline axis 27 of the camshaft 26. The cup portion 34 of the roller 32 of the roller cam follower 30 pushes against the spherical end 60 of the pushrod 58, and the cupped end 62 of the pushrod 58 lifts the first end 50 of the rocker arm 46. The motion of the first end 50 of the rocker arm 46 forces the actuation end 56 of the rocker arm 46 to place on the top 114 of the tappet 74 a force that is directed towards the fuel injector body 70. The force of the actuation end 56 of the rocker arm 46 overcomes the force of the spring 80 against the tappet surface 115 and causes the top 114 of the tappet 74 to travel towards the fuel injector body 70. The movement of the tappet 74 causes the protrusion 100 of the retention clip 72 to slide within the retention slot 127 towards the top 128 of the retention slot 127. The tappet 74 drives the plunger 76 towards the nozzle 82 of the fuel injector body 70, and the stroke of the plunger 76 within the fuel injector 64 pressurizes fuel below the plunger 76 so that fuel commences to spray out of the nozzle 82 in a manner well known in the art.

The camshaft 26 continues to rotate, moving the profile cam portion 28 out of contact with the roller cam follower 30. The roller 32 of the roller cam follower 30 moves closer to the centerline axis 27 of the camshaft 26, thereby removing pressure from the spherical end 60 of the pushrod 58. The lack of pressure on the pushrod 58 removes the force upon the first end 50 of the rocker arm 46. Thus, the pressure against the top 114 of the tappet 74 by the actuation end 56 of the rocker arm 46 is withdrawn. The force of the spring 80 on the tappet surface 115 causes the top 114 of the tappet 74 to move away from the fuel injector body 70. This movement of the top 114 of the tappet 74 drives the actuation end 56 of the rocker arm 46 away from the injector body 70 and, thereby, forces the first end 50 of the rocker arm 46 against the cupped end 62 of the pushrod 58. The force against the pushrod 58 keeps it in contact with the cup portion 34 of the roller cam follower 30.

If the plunger 76 is attached to the tappet 74, the movement of the tappet 74 away from the injector body 70 pulls the plunger 76 along with the tappet 74, and fuel is introduced into the area between the plunger 76 and the nozzle 82. If the plunger 76 is a free-floating plunger, the plunger 76 is moved away from the nozzle 82 by the force of fuel introduced between the plunger 76 and the nozzle 82. As the top 114 of the tappet 74 moves away from the injector body 70 due to the force of the spring 80, the protrusion 100 of the retention clip 72 slides within the retention slot 127 towards the bottom 129 of the retention slot 127. An optimally dimensioned retention slot 127 results in the protrusion 100 not contacting the bottom 129 or top 126 of the retention slot 127 at any time during the fuel injector's 64 operation. In addition, the optimally-dimensioned retention slot 127 has a width such that the friction between the sides 130 of the retention slot 127 and the outer surface 112 of the protrusion 100 during the operation of the fuel injector 64 is minimal.

The fuel injector 64 of the present application solves many problems. The interaction between the retention clip 72, the tappet 74 and the fuel injector body 70 retain the fuel injector 64 as a one-piece assembled unit prior to its installation. In addition, the fuel injector 64 of the present application can utilize a one-piece tappet 74, increasing the speed and ease of assembly and reducing the number of parts that must be designed and manufactured. Because there is only minimal, if any, contact between the retention clip 72 and the plunger 76 during fuel injector 64 operation, the fuel injector 64 may use a free-floating plunger 76. Also, the retention clip's 72 effect on the motion of the tappet 74 during fuel injector 64 operation is nominal because there is little to no contact between the protrusion 100 of the retention clip 72 and the cylindrical body 116 of the tappet 74. Also, if any contact between the protrusion 100 and the cylindrical body 116 produces burrs or other debris, that debris is separated from the bore 90 of the fuel injector body 70. This separation helps to avoid the advanced fuel injector 64 wear and premature fuel injector 64 failure that can occur if such debris is introduced to the fuel injector 64.

Other aspects, objects, and advantages of this invention can be obtained from a study of the drawings, the disclosure, and the appended claims.

What is claimed is:

1. A fuel injector comprising:

an injector body having a barrel, said barrel having an inner surface and an outer surface and defining a retention opening, said barrel inner surface defining a bore;

a tappet slidably engaged with said injector body barrel outer surface, said tappet defining a retention slot therethrough;

a biasing means; and a retention clip having a body located within said injector body bore and having a protrusion that extends through said retention opening and into said retention slot.

2. The fuel injector of claim 1 wherein said tappet is one integral piece.

3. The fuel injector of claim 1 wherein said tappet has a top, a longitudinal axis, and a cylindrical body having an inner surface and a bottom surface.

4. The fuel injector of claim 3 wherein said retention slot is substantially parallel with said longitudinal axis of said tappet.

5. The fuel injector of claim 3 wherein said inner surface of said tappet cylindrical body and said bottom surface of said tappet cylindrical body intersect via a chamfered edge.

6. The fuel injector of claim 3 wherein said biasing means is a spring having a top end and a bottom end, said top end contacting a surface spaced from said top of said tappet and said bottom end contacting said injector body.

7. The fuel injector of claim 1 wherein said fuel injector has a plunger slidably engaged with said inner surface of said barrel of said fuel injector body.

8. The fuel injector of claim 7 wherein said plunger is a free-floating plunger.

9. The fuel injector of claim 7 wherein said plunger has an annular indentation having a defined length.

10. The fuel injector of claim 9 wherein said retention clip body has a top surface and a bottom surface and the distance between said top surface and said bottom surface is not greater than said defined length of said annular indentation of said plunger.

11. The fuel injector of claim 1 wherein said protrusion of said retention clip has a circular cross section.

12. The fuel injector of claim 1 wherein said protrusion of said retention clip has a first end and at least one outer surface and said first end and at least one of said at least one outer surface intersect via a chamfered edge.

13. A method of making a fuel injector, said fuel injector having an injector body, a tappet, a biasing means, and a retention clip, said injector body having a centerline axis and a barrel, said barrel having an inner surface and an outer surface and defining a retention opening, said barrel inner surface defining a bore, said tappet having a cylindrical body with an inner surface, a bottom surface and a retention slot therethrough, and said retention clip having a body and a protrusion with a first end, said method comprising:

placing said retention clip into said bore of said barrel of said injector body such that said retention clip body is surrounded by said inner surface of said barrel of said injector body and said first end of said protrusion of said retention clip extends through said retention opening;

bringing said biasing means into contact with said fuel injector body;

moving said bottom surface of said tappet cylindrical body toward said injector body such that said inner surface of said tappet cylindrical body surrounds said outer surface of said barrel of said injector body;

aligning said retention slot with said retention opening;

moving said bottom surface of said tappet cylindrical body toward said protrusion of said retention clip such that said tappet forces said first end of said protrusion towards said centerline axis of said fuel injector body; and moving said bottom surface of said tappet cylindrical body such that said retention slot is aligned with said retention opening and said first end of said protrusion extends from said retention opening into said retention slot.

14. The method as specified in claim 13 wherein said tappet forces said first end of said protrusion towards said centerline axis of said fuel injector body via the interaction between said protrusion and a chamfered edge on said tappet cylindrical body.

15. The method as specified in claim 13 wherein said tappet forces said first end of said protrusion towards said centerline axis of said fuel injector body via the interaction between said tappet and a chamfered edge on said protrusion.

16. The method as specified in claim 13 wherein said biasing means is a spring having a top end, a bottom end, and an inside diameter, and bringing said biasing means into contact with said fuel injector body is accomplished by bringing said bottom end of said spring into contact with said fuel injector body such that said inner diameter of said spring surrounds said outer surface of said barrel of said injector body.

17. The method as specified in claim 13 wherein said fuel injector has a plunger and said retention clip body has an inner surface, said method including:

inserting said plunger into said bore of said barrel of said injector body such that said plunger is surrounded by said inner surface of said retention clip body.

18. An internal combustion engine comprising:

a cylinder block having at least one cylinder bore therein;

a cylinder head attached to said cylinder block; and at least one fuel injector positioned over said cylinder bore and attached to at least one of said cylinder block and said cylinder head, said fuel injector having an injector body, a tappet, a biasing means, and a retention clip, said injector body having a barrel, said barrel having an inner surface and an outer surface and defining a retention opening, said inner surface of said barrel defining a bore, said tappet slidably engaged with said outer surface of said barrel of said injector body and having a retention slot therethrough, and said retention clip having a body located within said bore of said barrel of said injector body and having a protrusion that extends through said retention opening and into said retention slot.

19. The internal combustion engine of claim 18 wherein said tappet is one integral piece.

20. The internal combustion engine of claim 18 wherein said tappet has a top, a longitudinal axis, and a cylindrical body having an inner surface and a bottom surface.

21. The internal combustion engine of claim 20 wherein said retention slot is substantially parallel with said longitudinal axis of said tappet.

22. The internal combustion engine of claim 20 wherein said inner surface of said tappet cylindrical body and said bottom surface of said tappet cylindrical body intersect via a chamfered edge.

23. The internal combustion engine of claim 20 wherein said biasing means is a spring having a top end and a bottom end, said top end contacting a surface spaced from said top of said tappet and said bottom end contacting said fuel injector body.

24. The internal combustion engine of claim 18 wherein said fuel injector has a plunger slidably engaged with said inner surface of said barrel of said injector body.

25. The internal combustion engine of claim 24 wherein said plunger is a free-floating plunger.

26. The internal combustion engine of claim 24 wherein said plunger has an annular indentation having a defined length.

27. The internal combustion engine of claim 26 wherein said retention clip body has a top surface and a bottom surface and the distance between said top surface and said bottom surface is not greater than said defined length of said annular indentation of said plunger.

28. The internal combustion engine of claim 18 wherein said protrusion of said retention clip has a circular cross section.

29. The internal combustion engine of claim 18 wherein said protrusion of said retention clip has a first end and at least one outer surface and said first end and at least one of said at least one outer surface intersect via a chamfered edge.

* * * * *